US010841990B1

(12) United States Patent
Usher et al.

(10) Patent No.: US 10,841,990 B1
(45) Date of Patent: Nov. 17, 2020

(54) FURNITURE SUPPORTED POWER CONTROL

(71) Applicants: Scott D. Usher, Teaneck, NJ (US); Daniel Deutsch, New York, NY (US)

(72) Inventors: Scott D. Usher, Teaneck, NJ (US); Daniel Deutsch, New York, NY (US)

( * ) Notice: Subject to any disclaimer, the term of this patent is extended or adjusted under 35 U.S.C. 154(b) by 0 days.

(21) Appl. No.: 16/538,368

(22) Filed: Aug. 12, 2019

(51) Int. Cl.
*H05B 45/10* (2020.01)
*A47C 21/00* (2006.01)
*A47C 31/00* (2006.01)

(52) U.S. Cl.
CPC ..... *H05B 45/10* (2020.01); *A47C 21/003* (2013.01); *A47C 31/008* (2013.01)

(58) Field of Classification Search
CPC ..... H05B 45/10; A47C 21/003; A47C 31/008
See application file for complete search history.

(56) References Cited

U.S. PATENT DOCUMENTS 8,148,851 B2 * 4/2012 Hahnlen ..... H05B 47/10 307/113
8,172,589 B2 * 5/2012 Johnson ..... H02G 3/38 439/215
10,431,990 B1 * 10/2019 Forte ..... F21V 23/001
2016/0057841 A1 * 2/2016 Lenig ..... H05B 45/50 315/291
2017/0265287 A1 * 9/2017 Avrahamy ..... B01D 61/147
2018/0138799 A1 * 5/2018 Testani ..... H05B 47/10

* cited by examiner

*Primary Examiner* — Borna Alaeddini
(74) *Attorney, Agent, or Firm* — Arthur Jacob

(57) ABSTRACT

In a furniture supported power control arrangement and method, power is controlled selectively from one of two furniture locations in the arrangement. A three-way circuit is comprised of low-voltage wiring connecting a first double-throw electric switch carried at a first furniture location for selective manual actuation, and a second double-throw electric switch carried at a second furniture location for selective manual actuation. A low-voltage driver supplies low-voltage power to the three-way circuit, and a low-voltage room lighting system is connected to the three-way circuit, whereby low-voltage power is directed to or disconnected from the room lighting system as controlled selectively by actuation of either one of the first and second double-throw electric switches.

12 Claims, 2 Drawing Sheets

FURNITURE SUPPORTED POWER CONTROL

Figure 1:
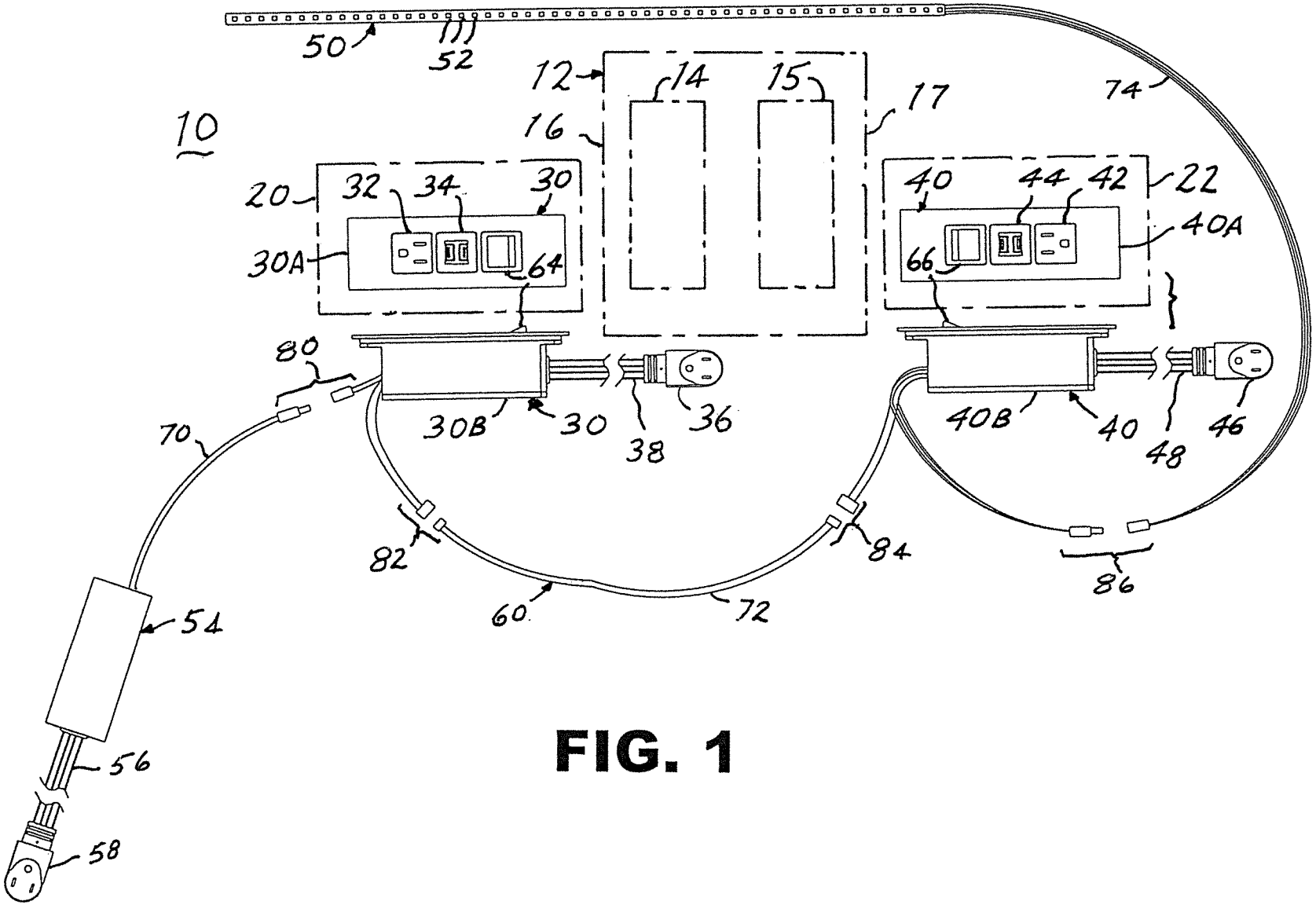

The present invention relates generally to a furniture power control arrangement and method and pertains, more specifically, to making available at any selected one item of furniture within a complex comprised of more than one furniture item the ability to control a powered system, such as a room lighting system within the complex.

It has become quite common to provide items of furniture with furniture power distribution units that enable the selective distribution of power to various powered components connected to such units. Thus, in commercial venues, such as hotels, motels and the like, as well as in domestic venues, furniture power distribution units have provided convenient access to power and data outlets, including power outlets for supplying power to a variety of selected appliances.

The present invention recognizes the convenience offered by currently available furniture power distribution units and takes advantage of that convenience to provide a person with the ability to control room lighting, especially while remaining comfortably in bed. More particularly, in instances where two people share a common bed, or adjacent beds, conventional three-way wiring systems provided between furniture items placed adjacent each side of a common bed, or at a convenient side of each adjacent bed, can enable each person with convenient access to selective control of the common lighting system. However, these conventional three-way wiring systems require the installation of substantial, hard-wired components capable of handling available standard line voltage, requiring extensive and relatively expensive installation procedures and construction, as well as concomitant permanently installed components.

The present invention accomplishes selective control of power to room lighting and the like from two convenient location, without the complexity and expense of current, conventional hard-wired installations designed to accomplish that end. As such, the present invention attains several objects and advantages, some of which are summarized as follows: Provides a convenient and economical furniture supported power control arrangement for enabling the selective control of power from either one of two convenient furniture locations; enables simple and economical installation of a complex that allows the selective control of power from either one of two convenient furniture locations; provides an effective, easily installed control complex for operation with increased ease and safety; enables increased versatility resulting from simplicity, ease and economy of installation; more particularly, provides an arrangement and method that enables two persons who share a room, and more specifically, who share a common bed, to have the ability of one person to control lighting in the room independent of the other person; furnishes an economical and highly reliable power control arrangement capable of long-term service.

The above objects and advantages are attained by the present invention, which may be described briefly as a furniture supported power control arrangement in which power is controlled selectively from either one of two furniture locations in the arrangement, the arrangement comprising: a first furniture location; a second furniture location; a three-way circuit comprised of low-voltage wiring connecting a first double-throw electric switch carried at the first furniture location for selective manual actuation, and a second double-throw electric switch carried at the second furniture location for selective manual actuation; a low-voltage driver connected to the three-way circuit for supplying low-voltage power to the three-way circuit; and a low-voltage component connected to the three-way circuit; whereby low-voltage power supplied by the low-voltage driver is directed to or disconnected from the low-voltage component as controlled selectively by actuation of either one of the first and second double-throw electric switches.

In addition, the present invention includes a power control method in which power is controlled selectively from either one of two furniture locations, the method comprising: providing a first furniture location; providing a second furniture location; providing a three-way circuit comprised of low-voltage wiring connected to a first double-throw electric switch carried at the first furniture location for selective manual actuation, and connected to a second double-throw electric switch carried at the second furniture location for selective manual actuation; connecting a low-voltage driver to the three-way circuit for supplying low-voltage power to the three-way circuit; and connecting a low-voltage component to the three-way circuit; thereby directing low-voltage power supplied by the low-voltage driver to or disconnecting such low-voltage power from the low-voltage component as controlled selectively by actuation of either one of the first and second double-throw electric switches.

Figure 2:
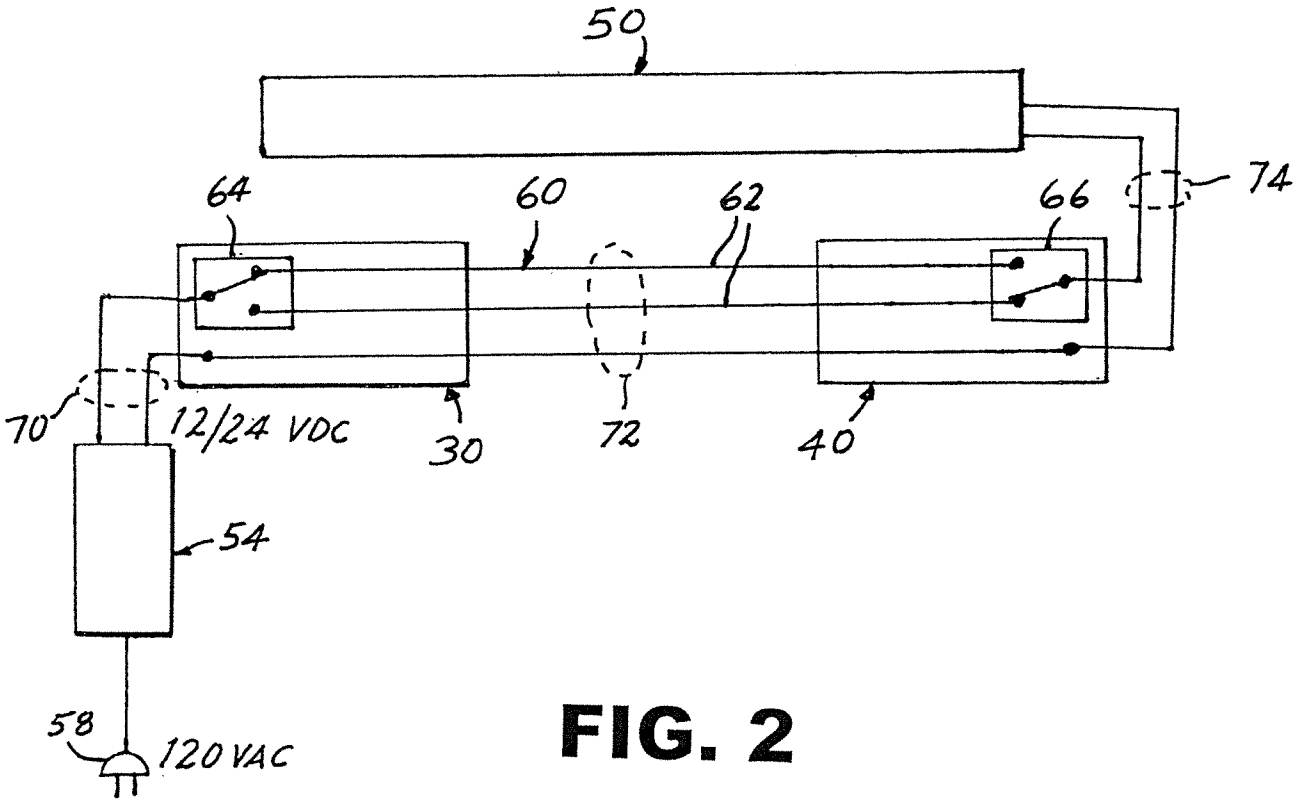

The invention will be understood more fully, while still further objects and advantages will become apparent, in the following detailed description of preferred embodiments of the invention illustrated in the accompanying drawing, in which:

FIG. 1 is a largely diagrammatic depiction of a furniture supported power control arrangement constructed and operated in accordance with the present invention; and FIG. 2 is a schematic diagram of the arrangement depicted in FIG. 1.

Referring now to the drawing, and especially to FIG. 1 thereof, there is depicted diagrammatically a hotel room 10 within which a bed, illustrated in phantom at 12, is placed for occupation by two guests 14 and 15, with each guest 14 and 15 situated adjacent a corresponding side 16 and 17 of the bed 12. A first furniture location is shown provided by a first night stand depicted in phantom at 20 and is placed in juxtaposition with one side 16 of bed 12. A second furniture location is shown provided by a second night stand depicted in phantom at 22, placed in juxtaposition with opposite side 17 of bed 12. Alternately, the first and second furniture locations can be provided by other items of furniture, such as bedside tables, night stands, one or more headboards, and the like.

First night stand 20 carries a furniture power distribution unit shown in the form of a first unit 30 depicted in a plan view at 30A and again in an elevational view at 30B. As is conventional in furniture power distribution units, unit 30 includes a conventional 120 VAC electrical receptacle 32 and a port 34 provided for data or charging. A conventional plug 36 is available for connection to a standard 120 VAC wall receptacle (not shown) for powering electrical receptacle 32 and port 34 through a line cord 38. Likewise, second night stand 22 carries a furniture power distribution unit shown in the form of a second unit 40 depicted in a plan view at 40A and again in an elevational view at 40B. Unit 40 includes a conventional 120 VAC electrical receptacle 42 and a port 44 provided for data and charging, with a conventional plug 46 for powering electrical receptacle 42 and port 44 through a line cord 48.

With reference now to FIG. 2, as well as to FIG. 1, a low-voltage component (typically requiring an operating voltage of 12 VDC or 24 VDC) is shown in the form of a room lighting system 50 located with respect to bed 12 so as to provide lighting as desired by guests 14 and 15. Lighting system 50 preferably includes a plurality of low-voltage LEDs 52 that provide effective illumination. In order to provide low-voltage power to lighting system 50, a low-voltage driver 54 is connected to lighting system 50 by means of a three-way circuit 60. Low-voltage driver 54 is powered conveniently through line cord 56 by insertion of a conventional standard 120 VAC plug 58 into a conventional 120 VAC receptacle available at an installation site and provides operating low-voltage, typically either 12 VDC or 24 VDC. Three-way circuit 60 is comprised of low-voltage wiring 62 connecting a first double-throw electric switch 64 carried by the first unit 30 and a second double-throw electric switch 66 carried by the second unit 40. Each electric switch 64 and 66 is placed adjacent a corresponding side 16 and 17 of bed 12 for convenient access enabling manual actuation by a corresponding guest 14 and 15. In this manner either guest 14 or 15 is provided with the ability to operate room lighting system 50 independent of the other guest 15 or 14.

All wiring between the units 30 and 40, as exemplified by cable 70, between the low-voltage driver 54 and the units 30 and 40, as exemplified by cable 72, and between the room lighting system 50 and the units 30 and 40, as exemplified by cable 74, is comprised of low-voltage wiring enabling a simplified, non-invasive installation in room 10. All that is required is a simple routing of cables 70, 72 and 74 between components of the illustrated arrangement, connection of cables 70, 72 and 74, facilitated by connectors 80, 82, 84 and 86, and insertion of conventional, standard plug 58 of low-voltage driver 54 into a convenient, standard 120 VAC receptacle. By eliminating the necessity for installing substantial, hard-wired 120 VAC components, as well as costly construction needed to accommodate such hard-wired components, all of which must comply with rigid standard procedures and specifications, and must be accomplished by qualified professionals, both installation time and expense is minimized, thereby facilitating and encouraging widespread use.

It will be seen that the present invention attains all of the objects and advantages summarized above, namely: Provides a convenient and economical furniture supported power control arrangement for enabling the selective control of power from either one of two convenient furniture locations; enables simple and economical installation of a complex that allows the selective control of power from either one of two convenient furniture locations; provides an effective, easily installed control complex for operation with increased ease and safety; enables increased versatility resulting from simplicity, ease and economy of installation; more particularly, provides an arrangement and method that enables two persons who share a room, and more specifically, who share a common bed, to have the ability of one person to control lighting in the room independent of the other person; furnishes an economical and highly reliable power control arrangement capable of long-term service.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A furniture supported power control arrangement in which low-voltage power is controlled selectively from either one of two furniture locations in the arrangement, the arrangement comprising:

a first furniture location;

a second furniture location;

a first double-throw electric switch placed for selective manual actuation at the first furniture location, and a second double-throw electric switch placed for selective manual actuation at the second furniture location;

low-voltage wiring connecting the first and second double-throw electric switches to establish a three-way circuit;

a low-voltage driver connected to the three-way circuit for supplying low-voltage power to the three-way circuit; and a low-voltage component connected to the three-way circuit;

whereby low-voltage power supplied by the low-voltage driver is selectively connected to or disconnected from the low-voltage component by selective actuation of either one of the first and second double-throw electric switches.

2. The furniture supported power control arrangement of claim 1 wherein the low-voltage component comprises a room lighting system.

3. The furniture supported power control arrangement of claim 2 wherein the room lighting system includes low-voltage LEDs.

4. The furniture supported power control arrangement of claim 3 wherein the first furniture location is provided by a first item of furniture for placement in juxtaposition with a first side of a bed, and the second furniture location is provided by a second item of furniture for placement in juxtaposition with a second side of the bed located opposite to the first side.

5. The furniture supported power control arrangement of claim 1 wherein the low-voltage driver includes a line cord and plug for connection to a conventional 120 VAC receptacle.

6. The furniture supported power control arrangement of claim 1 wherein the first furniture location is provided by a first item of furniture for placement in juxtaposition with a first side of a bed, and the second furniture location is provided by a second item of furniture for placement in juxtaposition with a second side of the bed located opposite to the first side.

7. A power control method in which low-voltage power is controlled selectively from either one of two furniture locations, the method comprising:

providing a first furniture location;

providing a second furniture location;

placing a first double-throw electric switch for selective manual actuation at the first furniture location, and placing a second double-throw electric switch for selective manual actuation at the second furniture location;

connecting the first and second double-throw electric switches with low-voltage wiring to establish a three-way circuit;

connecting a low-voltage driver to the three-way circuit for supplying low-voltage power to the three-way circuit; and connecting a low-voltage component to the three-way circuit;

thereby selectively connecting low-voltage power supplied by the low-voltage driver to or disconnecting such low-voltage power from the low-voltage component by selective actuation of either one of the first and second double-throw electric switches.

8. The method of claim 7 wherein the low-voltage component is provided in the form of a room lighting system.

9. The method of claim 8 wherein the room lighting system is provided in the form of low-voltage LEDs.

10. The method of claim 8 wherein the first furniture location is provided in the form of a first item of furniture for placement in juxtaposition with a first side of a bed, and the second item of furniture is provided in the form of a second item of furniture for placement in juxtaposition with a second side of the bed located opposite to the first side.

11. The method of claim 7 wherein the low-voltage driver is provided with a line cord and plug for connection to a conventional 120 VAC receptacle.

12. The method of claim 7 wherein the first furniture location is provided by a first item of furniture for placement in juxtaposition with a first side of a bed, and the second furniture location is provided by a second item of furniture for placement in juxtaposition with a second side of the bed located opposite to the first side.

* * * * *